US006832452B1

(12) United States Patent
Simens

(10) Patent No.: US 6,832,452 B1
(45) Date of Patent: Dec. 21, 2004

(54) MEGA PYRAMID STADIUM COMPLEX

(76) Inventor: Robert R. Simens, 34525 Sherbrook Park Dr., Solon, OH (US) 44139

( * ) Notice: Subject to any disclaimer, the term of this patent is extended or adjusted under 35 U.S.C. 154(b) by 61 days.

(21) Appl. No.: 10/206,754

(22) Filed: Jul. 28, 2002

Related U.S. Application Data

(60) Provisional application No. 60/308,473, filed on Jul. 28, 2001.

(51) Int. Cl.[7] ..... E04H 3/10

(52) U.S. Cl. ..... 52/6; 52/66; 52/236.6; 52/DIG. 10; 472/92

(58) Field of Search ..... 52/6, 66, 82, DIG. 10, 52/236.6, 236.3; 472/92

(56) References Cited

FOREIGN PATENT DOCUMENTS

JP 04357279 A * 12/1992 ..... 52/236.3

OTHER PUBLICATIONS

"Welcome To The Pyramid", 1999–2000, www.pyramidarena.com.*

"Amsterdam ArenA", 1996, www.foorballculture.net/insider/home_arena.html.*

"Las Vegas Hotels and Casino", 1996, www.luxor.com.*

"Alliance Arena", 2001, structurae.net/en/structures/data/str02923.php.*

* cited by examiner

*Primary Examiner*—Naoko Slack
(74) *Attorney, Agent, or Firm*—Vincent A. Greene

(57) ABSTRACT

A mega stadium-convention center complex is disclosed comprising an impressive pyramid building with a 670-foot pinnacle and a base covering more than 20 acres. The complex contains a 60,000-seat football stadium with a central playing field located more than 180 feet above the ground. The four-sided pyramid can be clad in tinted reflective glass or the like and has 8 or more floors below the playing field that provide several million square feet of floor space for a variety of different business and entertainment facilities.

The pyramid roof structure above the stadium and the playing field is adjustable and convertible and includes more than a dozen narrow retractable roof panels or strips and associated guide rails.

10 Claims, 8 Drawing Sheets

MEGA PYRAMID STADIUM COMPLEX

This application claims the benefit of provisional application Ser. No. 60/308,473 filed Jul. 28, 2001.

The invention relates to a massive multi-use sports building complex and to a mega pyramid stadium-convention center complex with a magnificent pyramid large enough to accommodate a convention center, a shopping mall, a parking garage, hotels, theaters and restaurants below a sports arena. The invention also relates to a unique adjustable and convertible roof structure of pyramid shape for covering a football or baseball stadium.

BACKGROUND OF THE INVENTION

For many years architects and developers have proposed and promoted expensive construction projects based on optimistic self-serving estimates as to the resulting economic regional impact. Similar economic arguments have been advanced by the owners of baseball and football teams in large cities to support demands for new stadiums, but economic experts have shown that sports teams and new stadiums do not in fact provide viable economic engines for a major city. Louisiana's Superdome happens to be one exception to that general rule.

When a multi-use domed stadium is combined with a nearby top-tier convention center, the economic impact can be substantial as proved in cities, such as Atlanta, St. Louis and Indianapolis, because visitors or tourists attracted from outside the region. That economic argument for a domed stadium may have credibility but was rejected in Chicago and in other major cities, such as Pittsburgh, Cleveland and Cincinnati, that decided to spend several hundred million dollars for construction of open-air roofless football stadiums that will be used only 10 to 15 days per year and that provide little, if any, economic impact. In a few cities, such as San Francisco and Phoenix, billion dollar sports/business complexes have been proposed as potential economic engines, but, so far, the response of a skeptical public has been unfavorable.

In Pittsburgh, after the votes turned down taxpayer funding for new baseball and football stadiums, private sources were able to raise $817 million for a new 300,000-square foot convention center and separate open-top football and baseball stadiums. However, because of the failure to provide a domed roof for the football stadium, the city may never host a Superbowl or a major political convention.

The simple fact is that developers have heretofore failed to demonstrate or convince political leaders that estimated potential economic advantages justify the inordinate costs and limited value of mega construction projects, such as billion-dollar shopping malls or sports-oriented building complexes.

Domed football stadiums can be constructed at modest or relatively low cost. The less expensive air domes, such as the Silverdome, are problematic and now considered obsolete. Cable-supported domes, such as the 1989 Tropicana Dome, near Tampa, are far superior but only two have been built in this country. The total construction costs for Atlanta's cable dome, the Georgia Dome, were reported to be about $160 million. However, fabric domes of this type are not favored by team owners and none have been seriously considered here for the last 10 years. The owners have instead promoted expensive retractable dome stadiums. The new baseball stadiums in Seattle and Milwaukee with rigid retractable roofs cost more than $500 million but have little economic impact.

For many years, in the field of sports stadiums, there has been a need for an attractive economical alternative to the retractable stadium roof, but this need was not met prior to the adjustable convertible dome of the present invention.

In the architectural field, buildings of pyramidal shape have been known for decades. Heretofore, in the field of sports arenas, the potential advantages of such a shape were not recognized. Prior to the present invention, the many advantages of a huge pyramid in a mega sports-building complex were not known or understood.

SUMMARY OF THE INVENTION

The purpose of the present invention is to provide a cost-effective sports-building complex with a magnificent pyramid that can serve as a superb landmark or focal point for a major city and also to provide an effective economic engine that is capable of creating tremendous economic growth.

Those objectives can be achieved in the embodiment of the invention illustrated schematically in FIG. 5 and in more detail in FIGS. 1 to 3, which could pay for itself within a few years because of the economic advantages.

In the practice of the invention, a mega stadium-convention center complex is provided comprising a huge pyramid with a height of 600 to 800 feet or more having a generally rectangular base with a substantial width, such as 800 to 1200 feet, covering 15 to 25 acres or more. The magnificent pyramid contains an elevated football or baseball stadium with a playing field located from 150 to 200 feet or more above ground level and has many floors below the playing field that provide several million or perhaps up to 5 million square feet of useful or leasable floor space.

The huge pyramid provides a mega complex large enough to accommodate a variety of business, educational, recreational and entertainment activities (e.g., theaters, restaurants, offices, apartments, swimming pools, retail stores and the like). One or more lower floors of the complex near or below ground level can be used as a parking garage with more than one million square feet of parking space.

The present invention provides a unique mega sports-building complex of the type illustrated in FIG. 5, for example, which can be a magnificent functional structure of tremendous potential that could have a major, major economic impact on a large metropolitan area.

Recent events seem to confirm such an optimistic prediction. A Washington Post article published in The Plain Dealer on Jul. 21, 2002, describes a $2 billion complex currently proposed for Syracuse, N.Y., by the Pyramid Group that combines a huge shopping center with a 15,000-seat amphitheater, an aquarium, and a theater-tourist hotel center. An excerpt from that article reads as follows:

"At more than 4 million square feet, DestiNY would exceed Minnesota's Mall of America. A Pyramid-sponsored consultant's report claims it will attract 35 million annual visitors, including 12 million from outside New York and 2 million international tourists. More than $12.5 billion in annual economic activity, including as many as 122,000 jobs at average wage of $31,000, is projected.

Mayor Matt Driscoll says the city double-checked the developer's figures, finding them credible."

The pyramid-shaped roof above the stadium and the playing field is preferably provided with narrow parallel retractable panels, as in FIG. 5, for example, so that portions of the roof can be opened to facilitate air circulation and light transmission to the playing field during sports events.

The retractable panels are an important feature of a unique adjustable convertible roof structure of general utility that constitutes an independent or distinct invention applicable to ordinary ground-level stadiums or to retrofits of existing baseball or football stadiums. The convertible roof structure, as illustrated in FIGS. 8 and 9, for example, unlike that of a $500-million retractable roof stadium, is relatively inexpensive to build and has other major advantages over the conventional rigid retractable roof which is normally fully open or fully closed during a scheduled sporting event, such as a football game.

For example, a common practice (to offset the obvious disadvantages of a retractable roof) is to heat or cool the interior of a retractable-roof stadium for 8 hours or more before a scheduled game while the roof is fully closed and then to open the roof and keep it open during the game. This strategy would be much more effective with the convertible roof structure of the present invention because the individual retractable panels can be adjusted in accordance with the outside weather conditions to optimize the comfort level for the spectators. This is particularly true in an insulating-type roof system of the type shown in FIG. 8 which helps to reduce heat transfer and the rate of temperature change during the sports contest.

The adjustable convertible roof system of this invention is particularly advantageous on very warm summer days and chilly winter days where air conditioning or heating is not urgently needed and can be omitted when the narrow roof panels (p) are carefully adjusted to improve spectator comfort. This option is not available or possible with conventional retractable roofs, such as the stadium roof in Seattle.

One of the more important objects of the present invention is to provide a cost-effective sports-oriented mega building complex with remarkable economic advantages that can pay for itself in a short period of time.

Another object is to provide an adjustable convertible stadium roof structure that improves spectator comfort in a variety of adverse weather conditions and that can be constructed at relatively low cost.

Other objects, uses and advantages of the invention will become apparent to those skilled in the art from the drawings and the brief description which follows.

Figure 1:
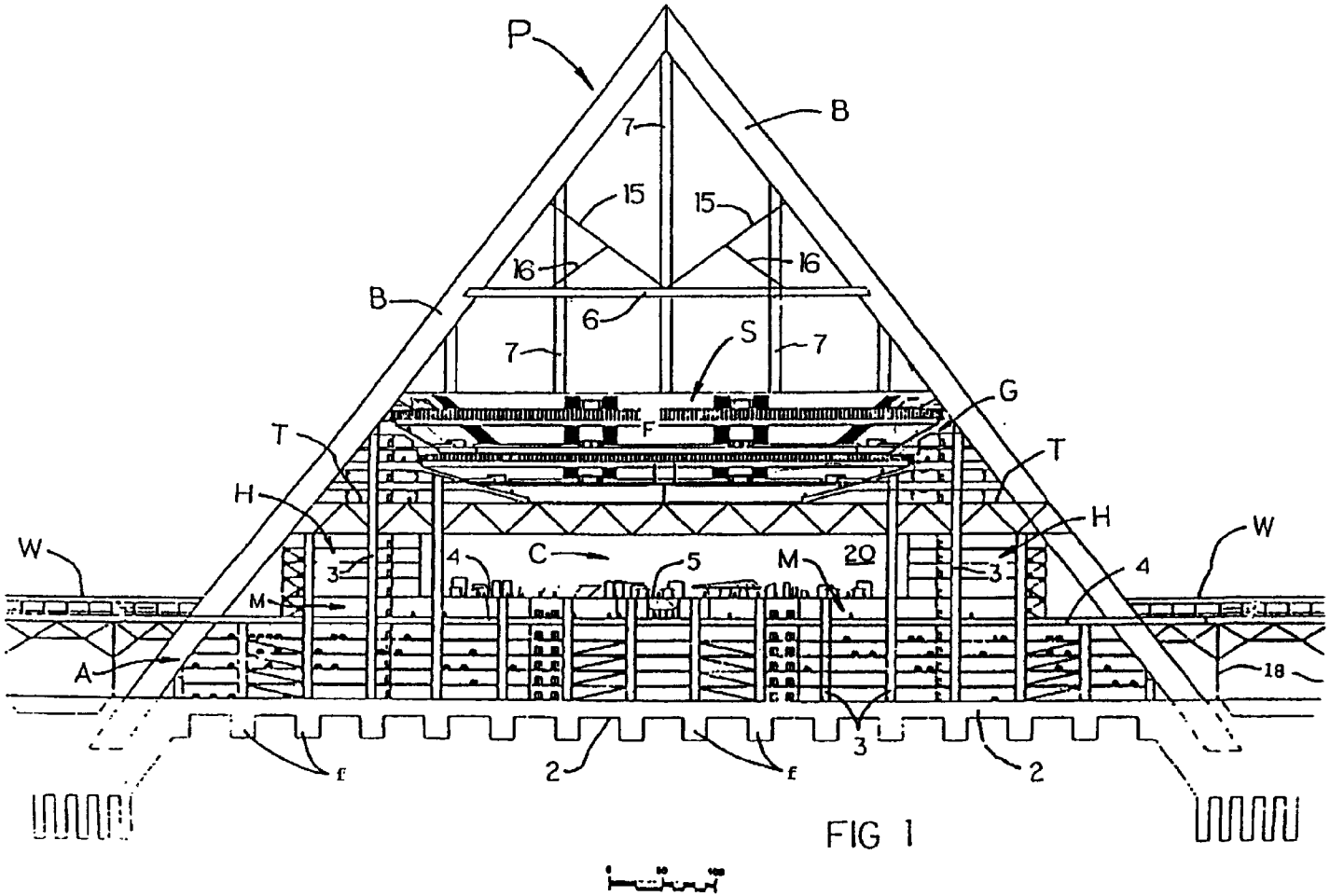
FIG. 1 is a schematic vertical sectional view on a reduced scale showing a proposed pyramid stadium-convention center complex.
Figure 2:
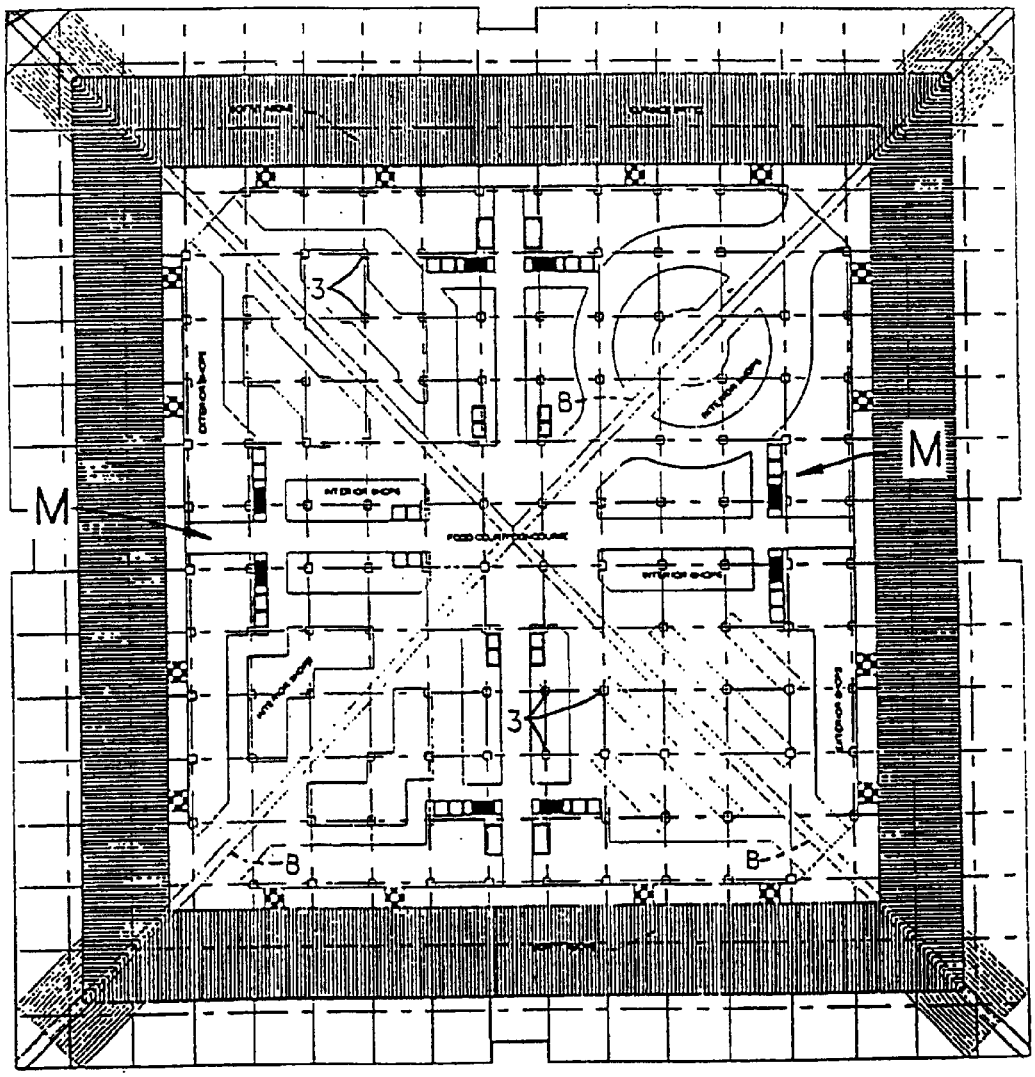
FIG. 2 is a schematic top plan view on a reduced scale showing an interior mall M at shopping level 6 below the convention center.
Figure 3:
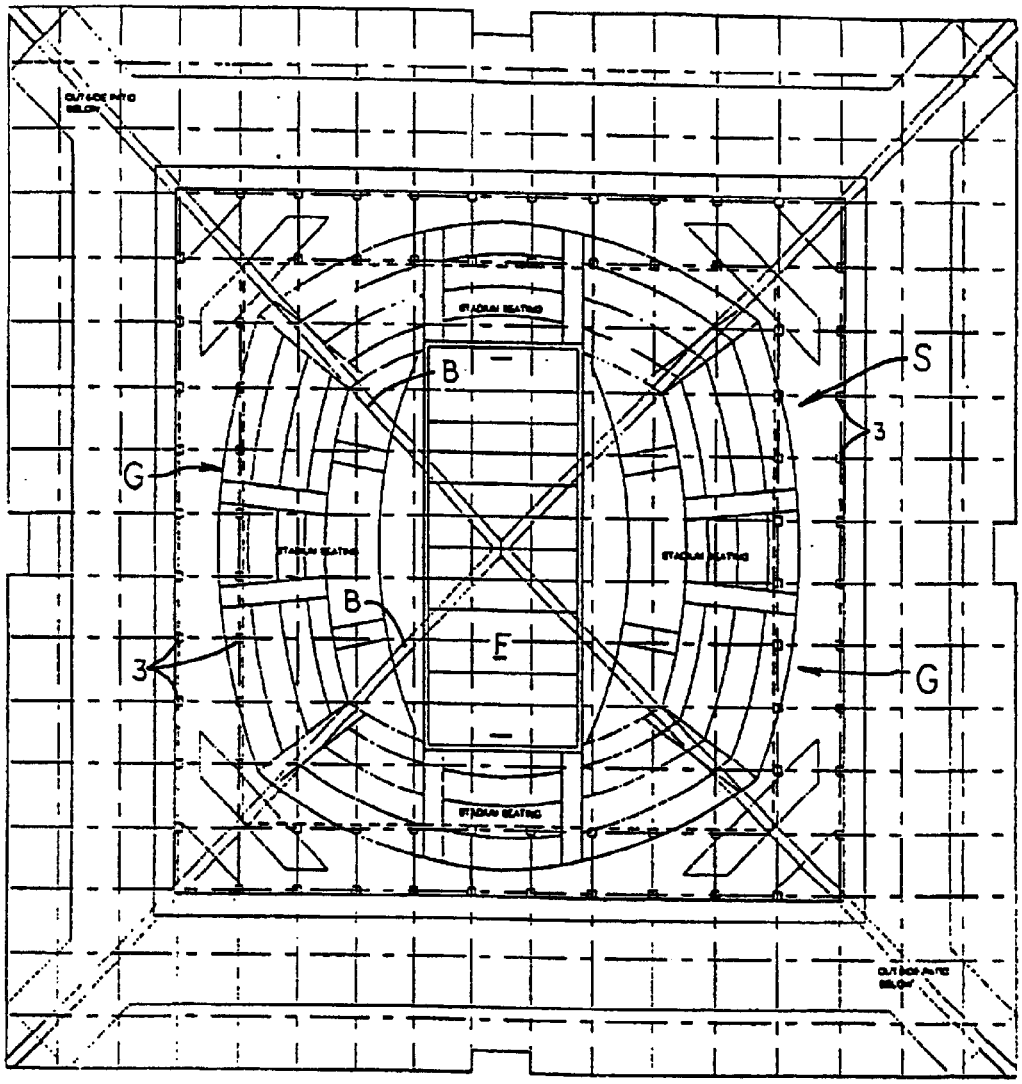
FIG. 3 is a schematic top plan view drawn substantially to scale like FIGS. 1 and 2 and showing a full size football stadium at levels 13 through 18 of the mega building complex.

It will be understood that FIGS. 1 to 3 are architectural views drawn substantially to scale, the proper scale being shown in a typical checkerboard fashion below the central portion of FIG. 1.

DESCRIPTION OF THE PREFERRED EMBODIMENTS

Figures 5, 5A:
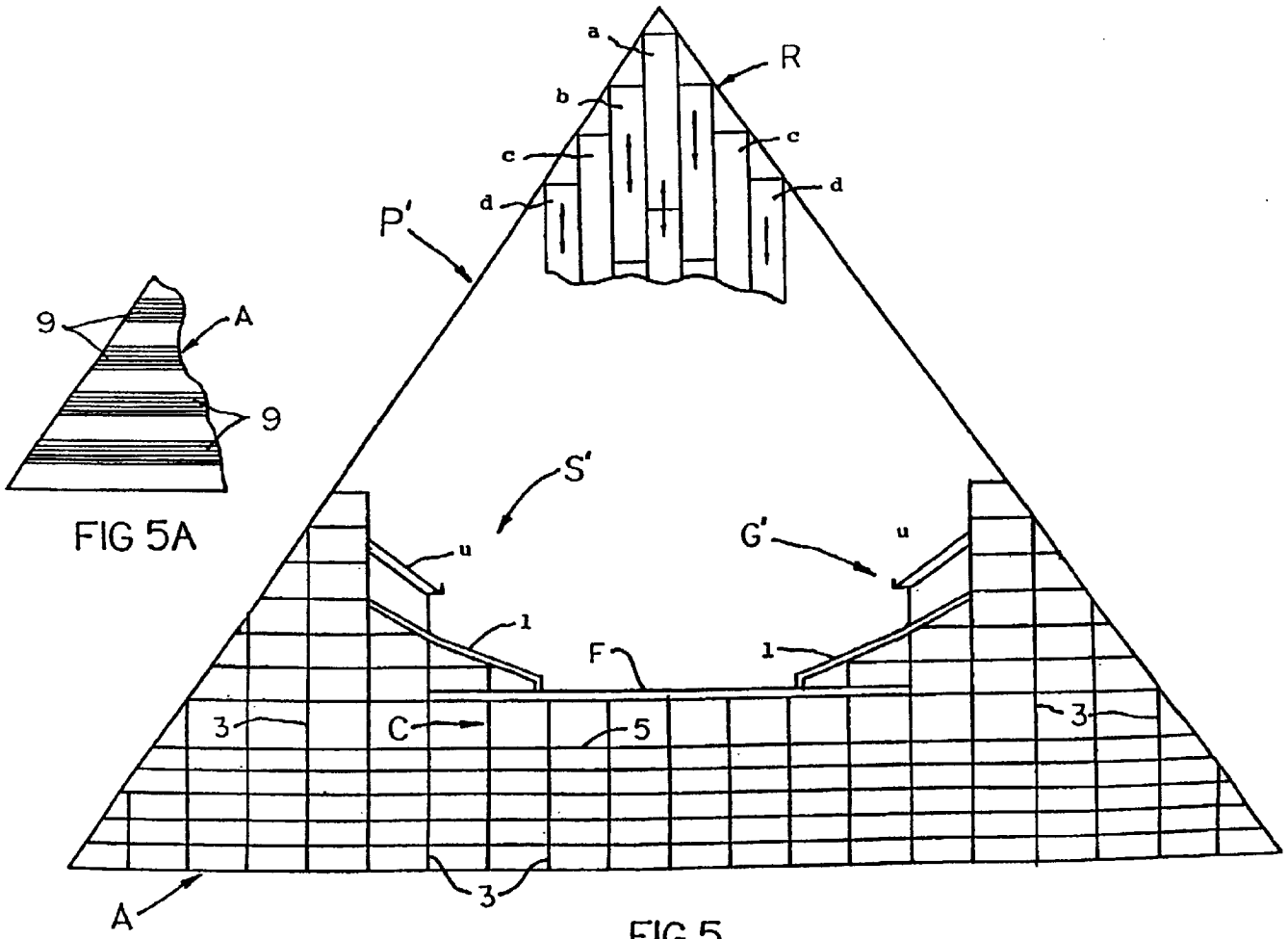
FIG. 5 is a schematic elevational view on a reduced scale with parts omitted and portions broken away showing the proposed pyramid stadium/building complex of the present invention on a reduced scale including retractable panel means (R) with series of parallel narrow rectangular panels a thru d that can be moved vertically as indicated by the vertical arrows.
FIG. 5A is a fragmentary schematic side elevational view on a reduced scale showing slotted ventilation openings that can be provided at garage levels 1 through 5.

The basic or fundamental features of the present invention have been summarized previously and are included in one version shown in schematic FIG. 5. A somewhat similar architect's version of the huge pyramid building structure is set forth in FIGS. 1, 2 and 3 which depict an impressive billion-dollar pyramid sports-building complex P featuring a large 4-story convention center or exhibition hall and adjoining hotels located above a shopping mall and below an elevated football field.

As illustrated in FIGS. 1 to 3, the mega stadium-convention center complex P has the general shape of an Egyptian pyramid with narrow 800-foot corner beams B at the four inclined edges of the pyramid that extend from each of the four corners at ground level to the central apex more than 650 feet above the ground. As shown, the pyramid is supported on a generally flat square base 2 of reinforced concrete having a multitude of footer portions f aligned vertically with an equal number of vertical reinforced-concrete posts or columns 3 (e.g., of the type used in the Georgia Dome). The columns 3 are regularly arranged in lateral and longitudinal rows as shown in FIGS. 2 and 3 with the conventional 60-foot spacing between centers. Thus, the main horizontal reinforced-concrete floor of the shopping mall M of FIG. 2 is supported by almost two hundred columns 3, and the stadium S at levels 13 to 18 is supported by about 80 columns (See FIG. 3). The below-ground footers for the columns 3 preferably extend downwardly to bedrock, often more than 100 feet below ground level. The foundation for the building can, of course, be a major expense.

As shown in FIGS. 1 to 3, the pyramid building complex includes a parking garage A at levels 1 through 5, a shopping mall M at level 6, a huge exhibition hall or convention center C at levels 7 through 10 with hotels H at the four corners of the square, and an elevated football stadium S at levels 13 through 18 with conventional grandstands G for seating 50,000 to 65,000 spectators around the central playing field F.

A series of regularly-spaced parallel horizontal bridge-type trusses T with a length of about 700 feet and a vertical width of perhaps 25 to 30 feet (e.g., levels 11 and 12) are supported by the vertical columns 3 more than 50 feet above the flat horizontal floor 5 of the exhibition center C and provide support for the grandstands G and the playing field F. The ceiling height for the exhibition/convention center is preferably greater than the ceiling height of the shopping mall M (which can, for example, be from 30 to 40 feet or more). As shown, the huge exhibition hall 20 above the floor 5 can be big enough for several grand ballrooms with a ceiling height of at least 60 feet and can cover an exhibition floor area of more than 200,000 square feet.

Figure 4:
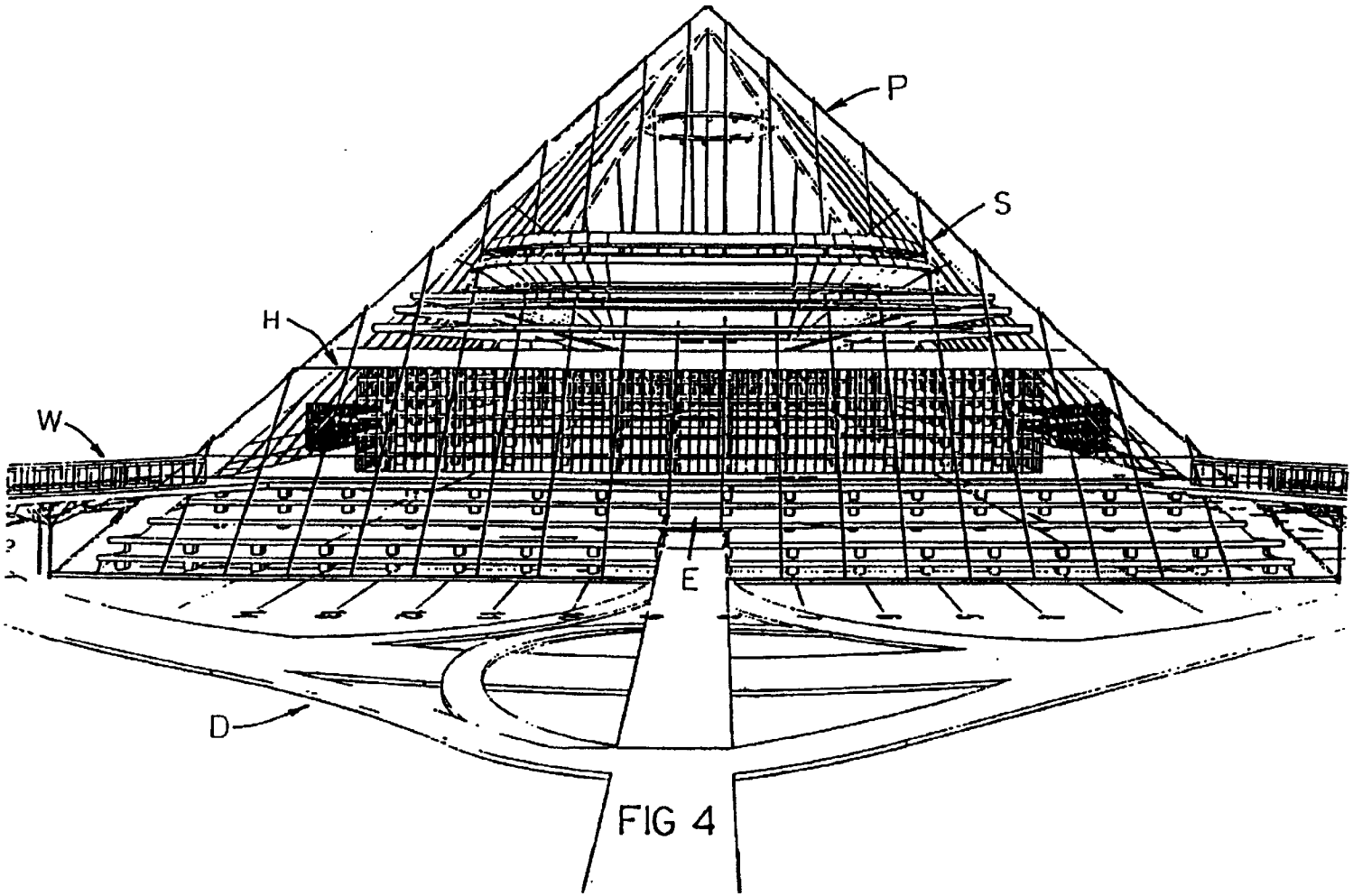
FIG. 4 is a schematic perspective elevational view on a reduced scale showing an architect's rendition of a pyramid building complex, such as the mega complex of FIGS. 1 to 3.

As indicated in FIG. 4, drives D can be provided around the pyramid building complex P to provide access roads leading to and from the several entrances E of the multi-level parking garage A, and steel-reinforced pedestrian bridges can be provided near corners of the building to form elevated walkways W that are supported on a series of posts 18 having a vertical length, such as 60 to 70 feet or more. The walkways lead directly to the shopping mall M at level 6 and escalators rising to convention center level 7. The parking garage A would, of course have conveniently-located elevators, ramps and stairways and preferably at least one entrance E at each of its 4 sides.

Figure 6:
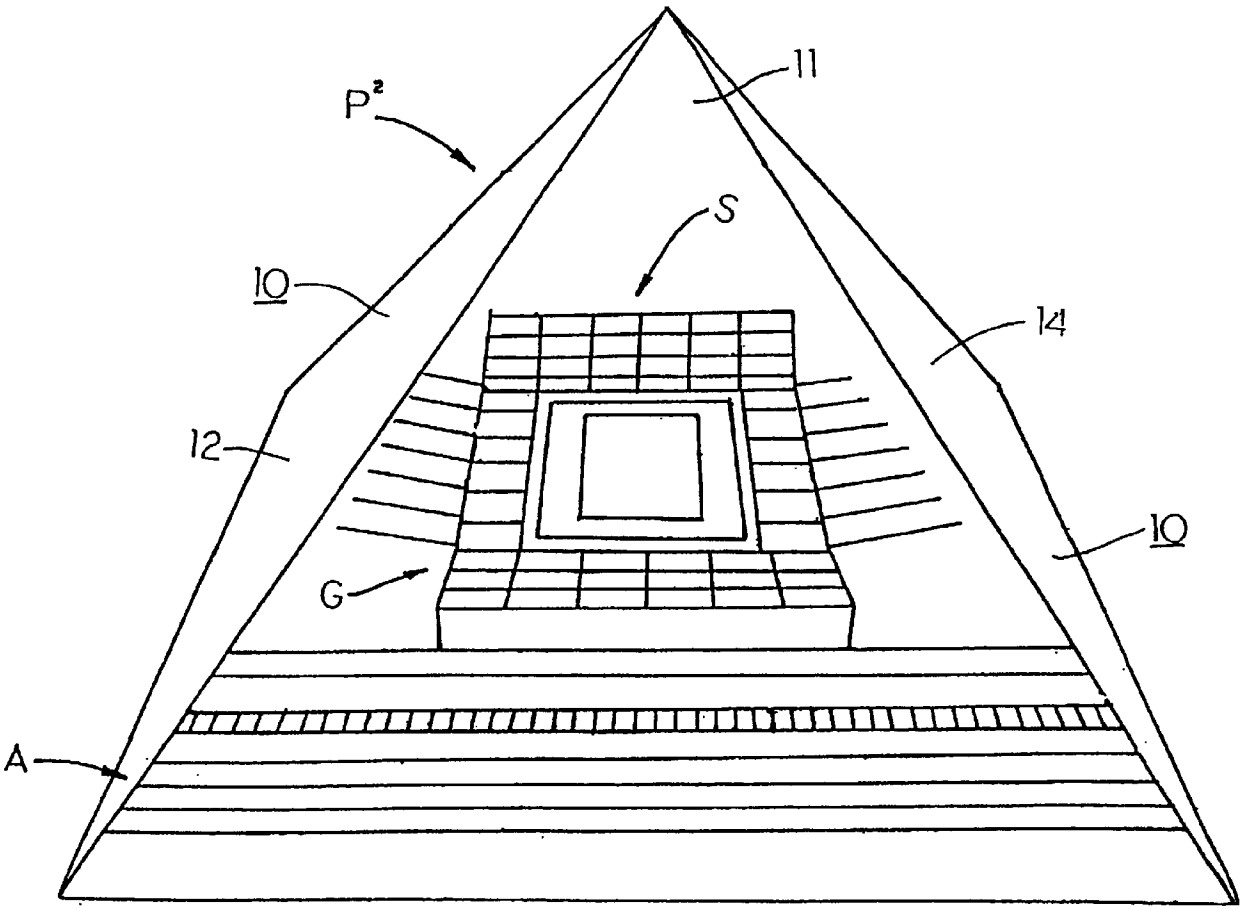
FIG. 6 is a crude schematic perspective view of a model of a building complex with an elevated football stadium comparable to that employed in the proposed building complex of FIG. 1, FIG. 4 or FIG. 5.

The pyramid building complex has four major triangular faces 11, 12, 13 and 14 as in FIG. 6, each with a total area up to 400,000 square feet covered with a suitable outer shell or cladding, such as sheets of light-transmitting glass or synthetic plastic and/or thin sheet metal. Tinted or reflective panes or panels formed of a clear or semitransparent sheet plastic or glass provide acceptable cladding for each of the faces 10 of the pyramid.

The main beams B at the four inclined edges of the pyramid are preferably reinforced as by triangular bracing means or the like. Each of the four faces 10 can be provided with bracing means, such as a 350-foot horizontal beam 6 perpendicular to a series of parallel beams or reinforcing strips 7 extending upwardly from each beam 6 to an associated corner beam B. Additional reinforcement can be provided by bracing means 15 and 16 as shown in FIG. 1.

FIG. 5A illustrates an optional construction for the parking garage A wherein each floor is provided with narrow horizontal ventilation slots 9 to assure adequate air circulation.

It will be understood that the steep sloping roof above the elevated stadium S may be provided with movable or retractable means for opening and closing large portions of the roof to facilitate air circulation and light transmission to the playing field. For example, as shown in FIG. 5, retractable cover means R may be provided near the top or apex of the pyramid on some or all four faces 10 including narrow retractable panels, such as the rectangular panels a, b, c and d, mounted in parallel relation to slide vertically on suitable track means or the like.

The garage A at levels 1 to 5 can provide parking for thousands of cars within the building complex. There will be additional above-ground and/or below-ground parking outside the pyramid building to complement both public transportation and pedestrian accessibility.

The commercial-retail shopping mall M at level 6 shown in FIG. 2 can cover an area of 400,000 square feet, large enough to accommodate at least one department store, a large number of smaller shops or stores and other facilities, such as banks or restaurants.

The football stadium S at levels 13 to 18 shown in FIG. 3 has grandstands G with lower decks l and upper decks u and preferably seats at least 60,000 spectators. The structure is preferably constructed of reinforced concrete like Atlanta's Georgia Dome, for example.

The convention center C at levels 7 to 10 can cover more than 200,000 square feet and can include a 5-floor hotel at each of the four corners of the square. The steel bridge trusses T above the convention center provide adequate support for the stadium S without the need for central supporting posts or columns (3). The trusses also provide space at levels 11 and 12 for heating and cooling ducts, fans, electrical equipment and other necessaries. The trusses can be hidden from view as by a suspended ceiling or the like with a height of 50 to 60 feet or more. The impressive exhibition hall and the underlying mall M at level 6 would be fully illuminated during daylight hours by natural light without the need for electric lighting.

Figure 7:
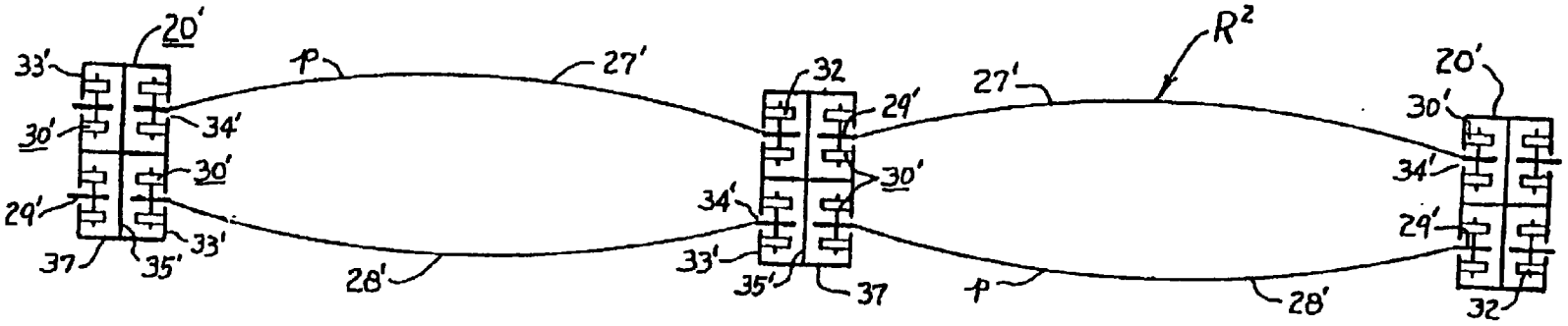
FIG. 7 is a fragmentary schematic cross-sectional view on a reduced scale with parts omitted showing a portion of an inflatable insulating cover having many parallel retractable panels.
Figure 8:
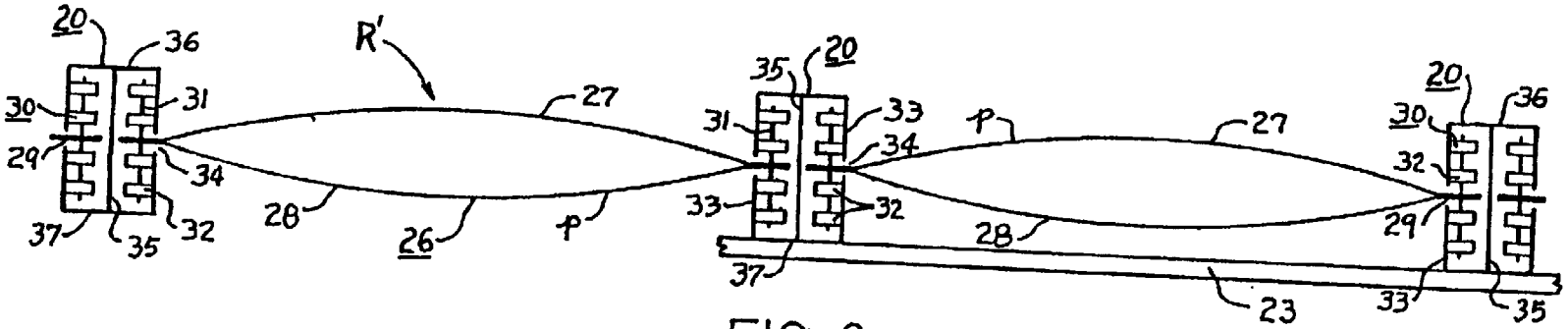
FIG. 8 is a fragmentary schematic cross-sectional view comparable to FIG. 7 and on the same scale showing a modified form of the inflatable insulating cover assembly in which the upper and lower panels of each pair are joined at their opposite sides to provide a lenticular cross section when inflated.
Figure 9:
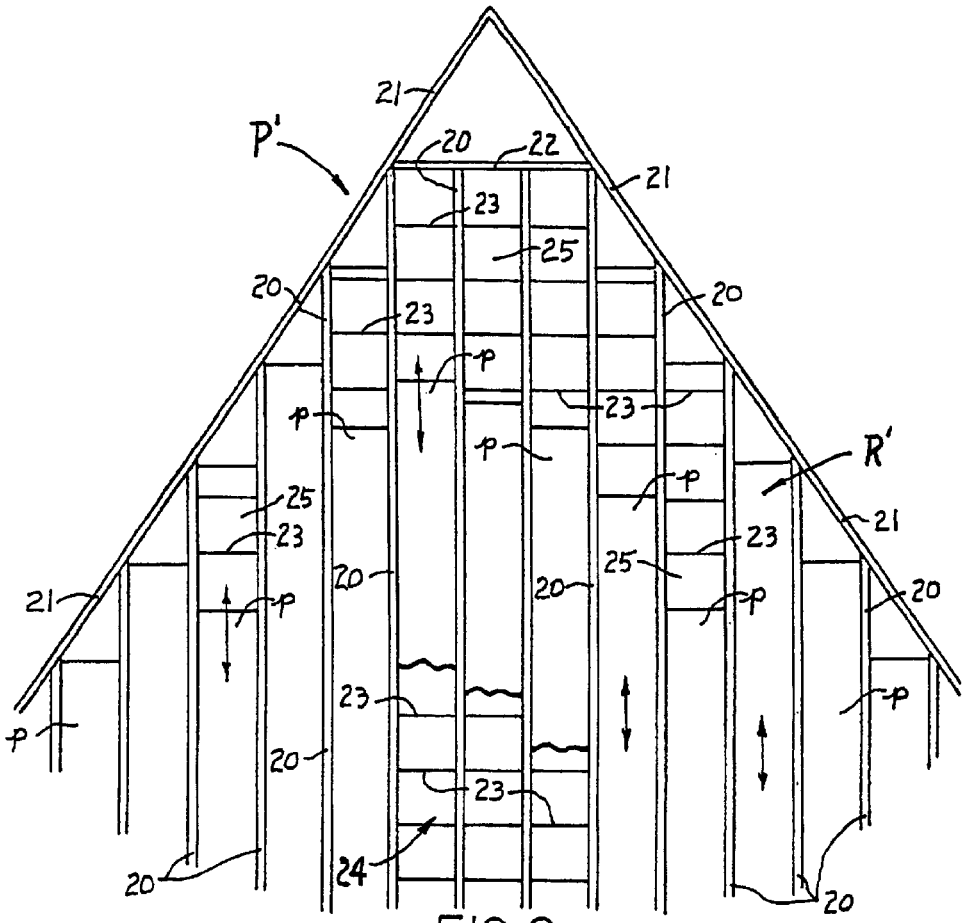
FIG. 9 is a fragmentary schematic side elevational view on a smaller reduced scale with parts omitted showing the narrow parallel rectangular panels of the cover assembly at one triangular face of the pyramid and the evenly spaced parallel guide beams, several of the narrow panels being shown in lowered position after being retracted from their normal uppermost closed positions.

FIGS. 7 to 9 illustrate a preferred embodiment of the present invention wherein the sports stadium (S) is covered by an adjustable convertible roof structure with many narrow retractable roof panels (e.g., see FIG. 5). The panels are preferably used in pairs to form tubular inflatable envelopes or bladder means of lenticular cross section as in FIG. 8 thereby providing effective roof insulating means when the panels are in their normal closed positions.

As shown, the pyramid P' of the mega sports-building complex is provided with a retractable or convertible roof or cover means R' above the grandstands of the stadium S including a series of 12 to 20 evenly spaced parallel guide rails or guide beams 20 serving as track means for a large number of narrow retractable strips or panels located on each of the four triangular faces of the pyramid. The upper ends of the guide rails 20 are connected to inclined corner beams 21, horizontal upper beams 22, and optional horizontal lower beams (not shown) parallel to beams 22.

The guide rails are preferably attached to and held in the desired parallel positions by suitable horizontal crossties or crossbeams 23 as indicated in FIG. 8 (or by horizontal wire-rope cables). The rails 20 and the crossbeams 23 are evenly spaced and provide a flat rigid or rigidified metal network 24 as shown by the small fragment of FIG. 9. The flat network is supported by the inclined flat triangular face of the pyramid P' and conforms to and covers that face.

The panels p are formed of fiberglass or other architectural fabric (e.g., such as that used on Atlanta's Georgia Dome) or other suitable material and can be moved back and forth in a direction parallel to the rails 20 as indicated by the arrows in FIG. 9. Each panel can be moved with its bladder means 26 from a normal uppermost closed position to a retracted open position, the opening 25 above the retracted panel admitting light and allowing free flow of air into or out of the air space above the playing field F.

Before a football game or other scheduled event, all of the panels p can be fully retracted to their lowermost positions so that the stadium functions essentially the same as the ordinary open-air stadium without a roof or the same as a $500-million retractable stadium in the open-air-mode. However, unlike the costly retractable stadium, the number and size of the roof openings can be adjusted in accordance with predicted weather conditions for optimum comfort of the spectators and/or to eliminate unnecessary air conditioning (e.g., where the temperature is a tolerable 80 to 85 degrees F.)

As shown in schematic FIG. 8, a pair of panels 27 and 28 are clamped together at their opposite sides by flat rigid metal clamping strips 29 to form a narrow tubular inflatable envelope or bladder means 26 of lenticular cross section containing air under a suitable pressure, such as 40 to 60 (psf) pounds per square foot. The outer panel 27 may have a special protective or reflective coating or covering to control light transmission, to minimize damage from ultraviolet rays, and/or to improve appearance.

Each of the special guide rails 20 contains suitable anti-friction means for guiding the associated narrow bladder means 26 as it is moved back and forth to the desired position. As shown in schematic FIG. 8, such means can include a wheel-track assembly 30 with axle s 31 extending through and supporting the clamping strips 29 and wheels 32 engaging the side portions or side flanges 33 of the guide rails 20. The side flanges at each side of the guide rail are spaced apart to provide a straight narrow guide slot extending the full length of the rail to receive and engage the associated clamping strip 29 and guide it as the panels p are advanced or retracted.

The provision of slots 34 at both sides of each guide rail 20 requires the rails to be specially fabricated and provided with a narrow vertical web portion or web plate 35 extending between and perpendicular to the flat top and bottom portions 36 and 37. The necessary web at 35 can be provided in different ways. The cross section of the complex rail 20 is somewhat similar to that of a simple I-beam (with added flanges 33) or to that of an H-beam widened to received flanges 33. The unusual cross section could also be provided by joining or welding together two slotted box beams, thereby doubling the thickness of the web at 35. The methods that could be used to make the guide rails 20' of FIG. 7 would perhaps be comparable to or almost the same as those suitable for making the rails 20.

It will be understood, of course, that many different means would be suitable for guiding the narrow panels or strips p as they are moved back and forth to adjust their positions. The means chosen for commercial use in the practice of this invention would likely be less crude and much different from that conveniently shown herein for purposes of illustration.

FIG. 7 shows a modification and possible alternative to the apparatus of FIG. 8 wherein the upper and lower panels 27' and 28' (corresponding to the panels of FIG. 8) can be moved independently using a wheel-track assembly 30' similar to the assembly 30. The modification involves changes in the cross section of each guide rail, the rail 20' having four guide slots 34' instead of two and twice as many side flanges for engaging the wheels 32. It may be necessary or desirable to modify or narrow the guide slots at 34' and/or to add sealing means to reduce air leakage.

It will be understood that variations and modifications of the specific methods and devices shown or described herein may be made without departing from the spirit of the invention.

I claim:

1. A mega sports building complex comprising a pyramid with a height of at least 600 feet including an enclosed sports stadium having an elevated playing field at least 150 feet above ground level and at least five floors below the playing field providing several million square feet of useful floor space, adjustable and convertible cover means being provided above the playing field and the surrounding stadium including a series of regularly-spaced parallel guide rails (20) and a series of narrow retractable roof panels (27, 28), each panel being mounted for longitudinal movement between a pair of said guide rails.

2. A building complex according to claim 1 wherein pairs of said panels (27, 28) are joined or held together at the opposite sides of each panel to form a series of ten or more narrow inflatable bladder means (26) of generally oblong or lenticular cross section, and blower means are provided to maintain an air pressure of at least 30 psf in each of the bladder means.

3. A building complex according to claim 2 wherein rigid clamping strips (29) are provided at each side of the bladder means to prevent air leakage, narrow guide slots (34) are provided at opposite sides of each guide rail (20) to receive said strips, and track means (30) are provided on each guide rail to support and guide said strips as they are moved longitudinally to the desired adjusted position.

4. A mega sports-building complex comprising a pyramid with a vertical height of at least 600 feet having a rectangular base with a width substantially greater than the vertical height, an enclosed baseball or football stadium having an elevated central playing field located at least 150 feet above ground level and grandstands extending around the field, and a parking garage near or below ground level, said building complex having at least five floors above the garage and below the grandstands that contain at least several million square feet of leasable floor space for a convention center, a shopping mall, several multistory hotels, and other facilities.

5. A mega building complex according to claim 4 wherein a convention center and exhibition hall covering at least 200,000 square feet of floor space and having a ceiling height of at least 50 feet is located directly below and adjoining the central playing field and is fully illuminated by natural daylight.

6. A mega building complex according to claim 4 wherein the pyramid contains an open-air stadium with adjustable and convertible cover means supported above the playing field for opening and closing the roof to facilitate free air circulation and light transmission to the field, said cover means comprising a series of adjustable roof panels, each mounted to slide between an upper closed position and a lower open position, whereby the number and size of the roof openings can be changed or adjusted in accordance with existing weather conditions to promote spectator comfort.

7. A mega building complex according to claim 4 comprising a pyramid with a height of 600 to 800 feet having a base with a width up to 1200 feet covering more than 20 acres and having an enclosed convertible open-air sports stadium with an elevated central playing field located from 150 to 200 feet above ground level, and a parking garage at the base of the pyramid near or below ground level, said complex having grandstands around the playing field that seat at least 60,000 spectators and having at least five floors above the garage and below the grandstands that provide at least several million square feet of leasable floor space for professional, educational, recreational and entertainment facilities including theaters, restaurants, hotels, exhibition halls, auditoriums, offices, apartments, museums, retail stores, banks, department stores, shopping centers and the like.

8. A mega building complex according to claim 7 wherein the pyramid contains a multistory convention center and a shopping mall with a ceiling height of at least 30 feet, each covering a floor area of at least 200,000 square feet, and several multistory hotels located below and adjoining the grandstands at opposite sides of the playing field.

9. A mega sports-building complex (P) comprising a pyramid with a height of from 600 to 800 feet having a rectangular base covering more than 20 acres and supporting a convertible open-air stadium (S) having an elevated central playing field (F) located from 150 to 200 feet above ground level, a multifloor parking garage (A) near the base of the pyramid with more than one million square feet of parking space, grandstands (G) surrounding the playing field having seating for at least 60,000 spectators, said complex (P) having several floors above the parking garage and below the playing field (F) that provide at least several million square feet of useful or leasable floor space including a main floor immediately below the playing field containing a 4-story convention center (C) having at least 200,000 square feet of floor space and one floor below the convention center containing a shopping mall (M) having at least 400,000 square feet of floor space, and an adjustable and convertible roof structure mounted above the stadium (S) having many movable panels that can be retracted from their normal closed positions to facilitate free air circulation above the playing field.

10. A mega building complex (P) according to claim 9 having separate multistory hotels (H) located below the grandstands at several of the four corners of the stadium, each hotel having at least 5 floors above the level of the shopping mall (M).

* * * * *